United States Patent [19]

Lowe, Jr. et al.

[11] Patent Number: 4,771,370

[45] Date of Patent: Sep. 13, 1988

[54] LEG STRAP FOR U-SHAPED LAMP

[75] Inventors: John C. Lowe, Jr., Andover; James R. Stewart, Salem, both of Mass.

[73] Assignee: GTE Products Corporation, Danvers, Mass.

[21] Appl. No.: 67,329

[22] Filed: Jun. 29, 1987

[51] Int. Cl.[4] ..... F21S 5/00

[52] U.S. Cl. ..... 362/216; 362/260

[58] Field of Search ..... 362/216, 260

[56] References Cited

U.S. PATENT DOCUMENTS

| | | | |
|---|---|---|---|
| 3,337,035 | 12/1970 | Pennybacker | 313/178 |
| 3,548,241 | 12/1970 | Rasch et al. | 313/178 |
| 3,579,174 | 5/1971 | Gilbert | 313/318 X |
| 3,602,755 | 8/1971 | Hoeh | 313/318 X |
| 4,217,630 | 8/1980 | Albrecht | 362/217 |
| 4,422,010 | 12/1983 | Hammer | 362/216 |
| 4,598,343 | 7/1986 | Sorrell | 362/216 |
| 4,701,667 | 10/1987 | Cinalli | 313/594 |

FOREIGN PATENT DOCUMENTS

| | | | |
|---|---|---|---|
| 933526 | 9/1955 | Fed. Rep. of Germany | 362/216 |

*Primary Examiner*—Tony M. Argenbright

*Assistant Examiner*—Eric R. Carlberg

*Attorney, Agent, or Firm*—Carlo S. Bessone

[57] ABSTRACT

A one-piece leg strap for a U-shaped fluorescent lamp having two longitudinally extending leg members joined together by a U-bend portion. The leg brace includes an elongated central body portion and a pair of generally circular end portions. Each of the circular end portions defines an opening therewithin having an inside diameter relative to the outside diameter of a respective lamp base member. A non-slip friction fit retains the leg strap on the lamp base members. Means are provided in the leg strap to compensate for variations in the outside diameter of the lamp base members. In a preferred embodiment, a pair of notches are located at opposite ends of the central body portion and define first and second laterally flexible projecting members which allow the end portions of the leg brace to be easily slipped over the lamp base members. The leg brace supports the longitudinally extending leg members during handling, shipment and installation by preventing the leg members from being compressed or spread apart and also ensuring the proper spacing of the two base members.

8 Claims, 1 Drawing Sheet

LEG STRAP FOR U-SHAPED LAMP

TECHNICAL FIELD

This invention relates to U-shaped fluorescent lamps, and more particularly, to a leg strap which fits on the bases which are attached to the lamp legs of such a lamp and which is used for supporting those legs during handling, shipment and installation of the lamps.

BACKGROUND OF THE INVENTION

U-shaped fluorescent lamps are characterized by a 180-degree bend on one end joining a pair of longitudinally extending leg members which terminate in bases with electrical contacts which plug into electrical connecting sockets mounted in a mount, but arranged on the same end as contrasted with two typical straight lamps which each have a pair of bases and a pair of sockets mounted on opposite ends. The U-shaped lamps have a number of applications but are particularly useful in the contemporary commercial lighting industry. In the case of a U-shaped lamp as contrasted with a straight lamp, one U-shaped lamp does the work of two short straight lamps which means fewer ballasts and sockets must be purchased and installed. U-shaped lamp ends are only inches apart in one raceway and are not separated by many feet, reducing wiring requirements. Since only a single ended lamp support is required, less raceway work is needed. Accordingly, for many applications fewer U-shaped lamps than straight lamps can be utilized for doing the same illumination job with savings of materials, ballasts, sockets, labor, and energy.

However, the U-shaped lamp with its 180-degree bend on one end with the legs extending therefrom has been generally more fragile because of the bend, and accordingly considered to be more difficult to handle than a single straight lamp. The problem has arisen in handling and shipment as well as in installation. Little leeway is tolerated in lateral movement of the legs, and the lamps are particularly vulnerable when being plugged into dual sockets in the mount, because undue pressure on one leg in entry to the socket may fracture the lamp bend. This is particularly true when the lateral movement of legs is toward each other putting the glass on the outside of the bend in tension. Since glass is weakened by tension, the thinned outside of the bend is most vulnerable when the legs are moved toward each other in handling, shipping, carrying to the fixture for installation or while installing.

In order to prevent possible breakage problems and to ensure the spacing of the two bases or of the two leg members, it is well known to reinforce the free ends of such lamps and prevent them from being compressed or spread apart.

A one-piece slip-on brace member is disclosed in U.S. Pat. No. 3,337,035 issued to Pennybacker on Aug. 22, 1967. The brace is made from stiff wire and is provided with arcuate loops at each end that are slipped over and compressively grip the legs of the U-shaped envelope. While braces which encircle the envelope portions of the lamp leg members achieve the desired purpose, they are not entirely satisfactory since such braces cast shadows and/or decrease the amount of light output from the leg members.

Other types of braces or straps are known which either engage or interconnect with the lamp bases. For example, it is well known to provide each base with a metal clamp around its circumference in such manner that the flaps of the respective clamp point towards each other in the direction of the connection line of the two bases. The two clamps are then interconnected by means of a crossbar which is placed with its respective ends between the pair of clamp flaps and is riveted in place. Such an arrangement is similar to those illustrated in FIG. 2 of U.S. Pat. No. 3,548,241 issued to Rasch et al on Dec. 15, 1970 and in U.S. Pat. No. 4,422,010 issued to Hammer on Dec. 20, 1983 (elements 22,23,24).

U.S. Pat. No. 3,579,174, issued to Gilbert, Jr. on May 18, 1971, discloses another type of brace for U-shaped fluorescent lamps which interconnects with the lamp bases. This structure provides a notch in the circumference of each base, the notches facing one another and extending in the plane common to the base pins. The notched bases are interconnected by a bar which has a groove at its ends. The grooved ends engage in the respective notch at the base circumference. The assembly is then sealed with cement to the lamp ends.

U.S. Pat. No. 3,602,755, issued to Hoeh on Aug. 31, 1971, discloses a bracket with semicircularly or circularly curved ends as the spacer member; the straight-line portion of the bracket is passed through an aperture in the circumference of the respective base cap which is flush with the base pins so that the curved ends of the bracket come to lie internally of the base cap. A ring-shaped binding agent (cement ring) is introduced into the base caps and the whole assembly is sealed to the lamp ends by heating.

U.S. Pat. No. 4,217,630, issued to Albrecht on Aug. 12, 1980, teaches a spacer member which is formed to interconnect with a pair of specially designed base caps. Each cap has a pair of substantially parallel radially outwardly projecting members having extending means therebetween. The spacer member has respective ends slidably engagable between the outwardly projecting members for positive engagement with the extending means.

Braces which engage or interconnect with the lamp bases generally require either an aperture or notch to be formed in each of the bases or specially designed base caps.

In addition to the above-mentioned disadvantages, some of the prior methods employed do not easily accommodate variations in the outside diameter of the bases or are not readily adaptable for attachment to U-shaped fluorescent lamps using automated equipment.

BRIEF SUMMARY OF THE INVENTION

It is, therefore, an object of the present invention to obviate the disadvantages of the prior art.

It is still another object of the invention to provide an improved leg strap for U-shaped fluorescent lamps which prevents possible breakage problems and for ensuring the spacing of the two base members or of the two longitudinally extending leg members.

It is another object of the invention to provide a leg strap for U-shaped fluorescent lamps which can be inexpensively produced.

It is still another object of the invention to provide a leg strap for U-shaped fluorescent lamps which does not cast shadows and/or decrease the amount of light output from the leg members.

It is another object of the invention to provide a leg strap for U-shaped fluorescent lamps which can be used with existing bases and do not require specially designed base caps.

It is a further object of the invention to provide a leg strap for U-shaped fluorescent lamps which easily accommodates variations in the outside diameter of the base members.

It is still another object of the invention to provide a leg strap which is readily adaptable for attachment to a U-shaped fluorescent lamp using automated equipment.

These objects are accomplished in one aspect of the invention by the provision of a one-piece leg strap for a U-shaped fluorescent lamp having two longitudinally extending leg members joined together by a U-bend portion. Each of the leg members have a base member attached thereto. The leg strap includes an elongated central body portion and a pair of generally circular end portions located at opposite ends of the elongated central body portion. Each of the end portions define an opening therewithin. The opening in each of the end portions have an inside diameter related to the outside diameter of a base member associated therewith such that each of the end portions of the one-piece leg brace provides a non-slip friction fit on the base members.

In accordance with further teachings of the present invention, the leg strap further includes means for compensating for variations in the outside diameter of the base member. The compensating means includes a notch in the circular periphery of each of the end portions. The notches allow for expansion of the inside diameter of the opening of each of the end portions.

In accordance with further aspects of the present invention, the compensating notches are substantially semi-elliptical in shape and located at opposite ends of the elongated central body portion. Preferably, the notches extend into the central body portion of the one-piece leg strap. In a preferred embodiment, the notches define first and second flexible projecting members attaching each of the generally circular end portions.

In accordance with another aspect of the present invention, there is defined a U-shaped fluorescent lamp including two longitudinally extending leg members joined together by a U-bend portion, a pair of electrodes supported by lead-in wires spacedly located within the envelope, an ionizable medium contained within the envelope and a phosphor layer disposed within the envelope. Each of the leg members have a base member attached thereto.

The improvement comprises a one-piece leg strap including an elongated central body portion and a pair of generally circular end portions located at opposite ends of the elongated central body portion. Each of the end portions define an opening therewithin. The opening in each of the end portions has an inside diameter related to the outside diameter of a base member associated therewith such that each of the end portions of the one-piece leg strap provides a non-slip friction fit on the base members.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
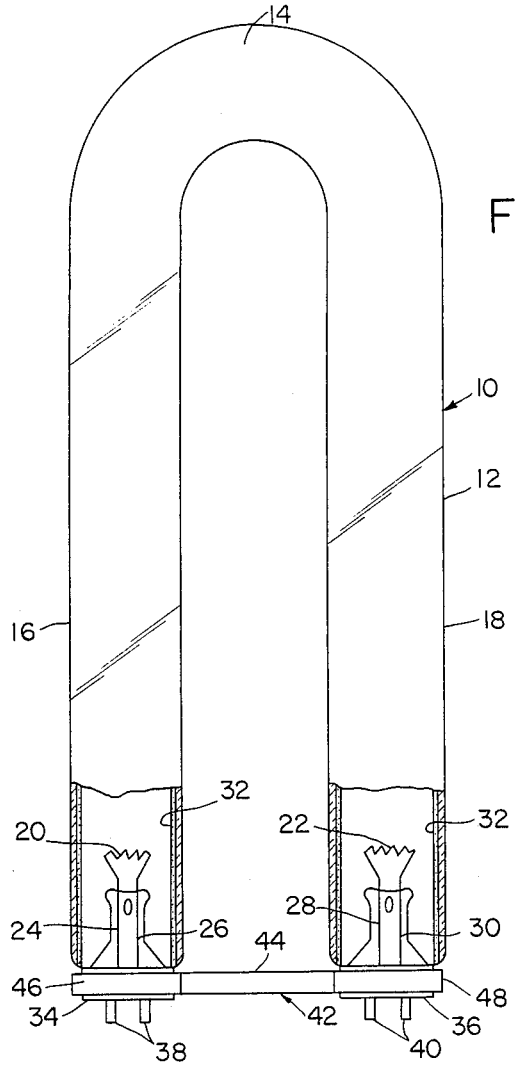
FIG. 1 represents a front elevational view, partially broken away, of an embodiment of a U-shaped fluorescent lamp with a preferred embodiment of the leg strap of the present invention.
Figure 2:
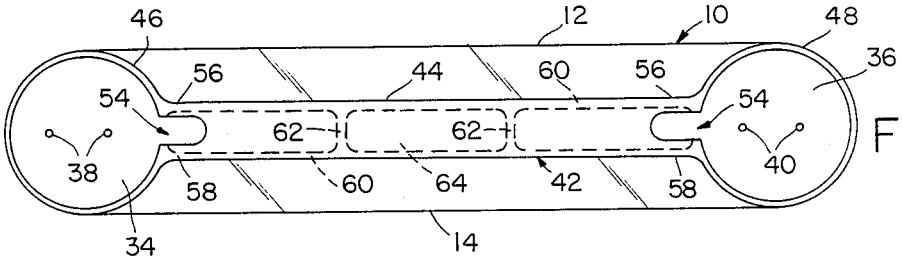
FIG. 2 is a bottom plan view of the fluorescent lamp and leg strap shown in FIG. 1.

Referring now to the drawings with greater particularity to FIGS. 1 and 2, there is illustrated a U-shaped fluorescent lamp 10 including a sealed envelope 12 of light-transmitting vitreous material such as a soda-lime or lead glass. The envelope includes a 180-degree U-bend portion 14 and a pair of longitudinally extending leg members 16, 18. A pair of electrodes 20, 22 supported by lead-in wires 24, 26 and 28, 30, respectively, is spacedly located within envelope 12 for generating an arc discharge therebetween during operation of lamp 10. Electrodes 20, 22 can be, for example, a double or triple-coiled tungsten filament of the usual type and carry a coating thereon which is usually in the form of carbonates which upon processing, are converted to oxide. Sealed envelope 12 contains an ionizable medium including a quantity of mercury and an inert starting gas at low pressure, for example, in the order of 1–5 mm of mercury. The starting gas can be, for example, argon, krypton, neon, or helium, or a mixture of these and other gases. A phosphor layer 32 disposed within sealed envelope 12 converts the ultraviolet radiation generated in the mercury discharge into visible radiation.

A base member 34, 36 having an outside diameter is telescoped over and attached to the ends of longitudinally extending leg members 16, 18 and include a pair of pins 38, 40 electrically connected to a portion of lead-in wires 24, 26 and 28, 30 and formed to provide electrical connection to an external source (not shown).

In accordance with the teachings of the instant invention fluorescent lamp 10 further includes an improved one-piece leg strap 42 for preventing possible breakage problems and for ensuring the spacing of the two base members or of the two longitudinally extending leg members. In a preferred embodiment, the leg strap includes means for compensating for variations in the outside diameter of the base member. More specifically, the compensating means includes a notch in the circular periphery of each of the end portions to allow for expansion of the inside diameter of the opening of each of the end portions.

Figure 3:
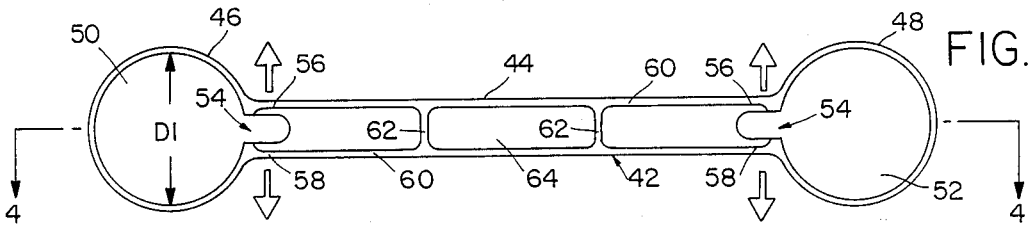
FIG. 3 is a top plan view of the leg strap used in the lamp shown in FIGS. 1 and 2.
Figure 4:
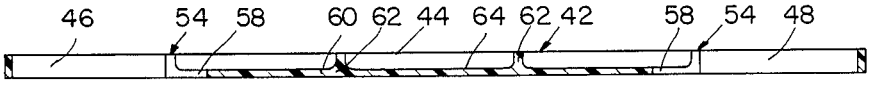
FIG. 4 is a front elevational cross sectional view of the leg strap taken along the line 4—4 in FIG. 3.

As shown in FIGS. 2–4, leg strap 42 is of a one-piece construction and includes an elongated central body portion 44 and a pair of generally circular end portions 46, 48 located at opposite ends of elongated central body portion 44. Each of the generally circular end portions 46, 48 define an opening 50, 52 (FIG. 3) therewithin. Opening 50, 52 in each of the end portions 46, 48 have a static inside diameter D1 which relates to the outside diameter of a base member 34, 36 associated therewith. The inside diameter D1 of opening 50, 52 is such that each of the end portions 46, 48 of leg strap 42 provides a non-slip friction fit on the base members.

As shown in FIGS. 2–4, elongated central body portion 44 is provided with longitudinal ribs 60 and lateral ribs 62 for strength. Ribs 60,62 are molded into surface 64 of leg strap 42.

In order to compensate for possible variations in the outside diameter of the base members 34, 36, leg strap 42 as best shown in FIGS. 2–4 is provided with a notch 54 in the circular periphery of each of the end portions 46, 48. Notches 54 allow for an expansion of the inside diameter D1 of the opening of each of end portions 46, 48.

In a preferred embodiment, a notch 54 is located at opposite ends of the elongated central body portion 44 and extends a predetermined distance thereinto. As best shown in FIGS. 2 and 3, notch 54 defines first and second projecting members 56 and 58 which are attached to each of the generally circular end portions 46, 48. Projecting members 56, 58 are laterally flexible (See direction arrows in FIG. 3) in order to allow an expansion of the inside static diameter D1 of openings 50, 52 and therefore permit end portions 46, 48 of leg strap 42 to be easily slipped over each respective base member 34, 36. Once the leg strap is attached to each of the base members, a non-slip friction fit retains the leg strap in place. Should it be necessary, the compensating means also permits the leg strap to be easily removed from the base members without damage to either the base members or the leg strap.

The notches may be of a shape other than the substantially semi-elliptical shape shown in FIGS. 2–4.

The entire leg strap 42 can be made of a plastic material such as Lexan (trademark) 940 available from General Electric Company located in Pittsfield, Massachusetts.

In a typical but non-limitative example of a U-shaped fluorescent lamp having a leg strap in accordance with the teachings of the present invention, the lamp was a Curvalume F40 type having a nominal envelope diameter of 1.5 inches (38.0 millimeters) and a longitudinal length (excluding the base pins) of approximately 22.425 inches (56.96 centimeters). The center-to-center spacing of the lamp leg members was approximately 6.0 inches (15.24 centimeters). The base members were conventional T12 medium bipin bases having an outside diameter of approximately 1.394 inches (35.41 millimeters). The leg strap included a pair of generally circular end portions, each having an opening with an inside diameter of approximately 1.382 inches (35.10 millimeters). The outside diameter of the circular end portions was approximately 1.47 inches (37.34 millimeters). The longitudinal distance from the center of one of the openings to the center of the other opening was equal to the lamp leg member spacing of 6.0 inches (15.24 centimeters). Each of end portions had a notch which extended approximately 0.313 inches (7.95 millimeters) into each end of the elongated central body portion of the leg strap as shown in FIGS. 2–4. The above leg strap will accommodate base members having an outside diameter ranging from about 1.389 inches (35.28 millimeters) to about 1.403 inches (35.64 millimeters).

There has thus been shown and described a one-piece leg strap for use with a U-shaped fluorescent lamp wherein the leg strap supports the leg members of the lamp during handling, shipment and installation of the lamp. The leg strap can easily accommodate the normal variations which exist in the outside diameter of the base members. Because of its design, the leg strap is inexpensive to produce, does not require specially designed base caps and is readily adaptable for attachment to the lamp using automated equipment. Also, the leg strap does not cast shadows and does not decrease the light output from the leg members.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

We claim:

1. A one-piece leg strap for a U-shaped fluorescent lamp having two longitudinally extending leg members joined together by a U-bend portion, each of said leg members having a base member attached thereto ,said leg strap comprising:

an elongated central body portion;

a pair of generally circular end portions located at opposite ends of said elongated central body portion, each of said end portions defining an opening therewithin, said opening in each of said end portions having an inside diameter relative to the outside diameter of a base member associated therewith such that each of said end portions of said one-piece leg strap provides a non-slip friction fit on said base members; and means for compensating for variations in said outside diameter of said base member, said compensating means comprising a notch in the circular periphery of each of said end portions, said notches located at said opposite ends of said elongated central body portion and extending into said central body portion, said notches allowing for expansion of said inside diameter of said opening of each of said end portions.

2. The U-shaped fluorescent lamp leg strap of claim 1 wherein said notch is substantially semi-elliptical in shape.

3. The U-shaped fluorescent lamp leg strap of claim 1 wherein said notches define first and second flexible projecting members attaching each of said generally circular end portions.

4. The U-shaped fluorescent lamp leg strap of claim 1 where said leg brace further includes longitudinal and lateral strengthening ribs in said elongated central body portion.

5. In combination with a U-shaped fluorescent lamp including two longitudinally extending leg members joined together by a U-bend portion, each of said leg members having a base member attached thereto, a pair of electrodes supported by lead-in wires spacedly located within said envelope, an ionizable medium contained within said envelope and a phosphor layer disposed within said envelope, the improvement comprising:

a one-piece leg strap including an elongated central body portion and a pair of generally circular end portions located at opposite ends of said elongated central body portion, each of said end portions defining an opening therewithin, said opening in each of said end portions having an inside diameter relative to the outside diameter member associated therewith such that each of said end portions of said one-piece leg strap provides a non-slip friction fit on said base members, and means for comprising for variations in said outside diameter of said base member, said compensating means comprising a notch in the circular periphery of each of said end portions, said notches located at said opposite ends of said elongated central body portion and extending into said central body portion, said notches allowing for expansion of said inside diameter of said opening of each of said end portions.

6. The U-shaped fluorescent lamp of claim 5 wherein said notch is substantially semi-elliptical in shape.

7. The U-shaped fluorescent lamp of claim 5 wherein said notches define first and second flexible projecting members attaching each of said generally circular end portions.

8. The U-shaped fluorescent lamp of claim 5 wherein said leg strap further includes longitudinal and lateral strenthening ribs in said elongated central body portion.

* * * * *